US006527269B2

(12) United States Patent
Yamada et al.

(10) Patent No.: US 6,527,269 B2
(45) Date of Patent: Mar. 4, 2003

(54) METHOD AND APPARATUS FOR SHEET FINISHING CAPABLE OF PERFORMING AN EFFECTIVE JOGGING PROCESS

(75) Inventors: Kenji Yamada, Tokyo (JP); Nobuyoshi Suzuki, Tokyo (JP); Hiromoto Saitoh, Kanagawa-ken (JP); Shinji Asami, Satitama-ken (JP); Junichi Iida, Kanagawa-ken (JP); Hiroki Okada, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/886,109

(22) Filed: Jun. 22, 2001

(65) Prior Publication Data

US 2002/0060414 A1 May 23, 2002

(30) Foreign Application Priority Data

Jun. 22, 2000 (JP) ..... 2000-188059

(51) Int. Cl.[7] ..... B65H 31/36

(52) U.S. Cl. ..... 271/221; 271/240; 270/58.12; 270/58.27

(58) Field of Search ..... 271/238, 240, 271/248, 249, 221, 222; 270/58.08, 58.12, 58.17, 58.27

(56) References Cited

U.S. PATENT DOCUMENTS

| | | | | | |
|---|---|---|---|---|---|
| 3,910,568 | A | * | 10/1975 | Brown et al. | 271/221 |
| RE30,031 | E | * | 6/1979 | Snellman | 271/221 |
| 4,325,544 | A | * | 4/1982 | Magno et al. | 271/221 |
| 5,020,784 | A | | 6/1991 | Asami et al. | |
| 5,263,697 | A | | 11/1993 | Yamazaki et al. | |
| 5,320,336 | A | | 6/1994 | Asami | |
| 5,508,798 | A | | 4/1996 | Yamada | |
| 5,570,877 | A | | 11/1996 | Asami et al. | |
| 5,655,765 | A | | 8/1997 | Asami et al. | |
| 5,762,328 | A | * | 6/1998 | Yamada et al. | 270/58.08 |
| 5,788,229 | A | | 8/1998 | Asami et al. | |
| 5,857,670 | A | * | 1/1999 | Jung | 270/58.27 |
| 6,145,825 | A | * | 11/2000 | Kunihiro et al. | 270/58.27 |
| 6,199,853 | B1 | | 3/2001 | Andoh et al. | |
| 6,231,045 | B1 | | 5/2001 | Yamada et al. | |
| 6,264,191 | B1 | | 7/2001 | Suzuki et al. | |
| 6,296,247 | B1 | | 10/2001 | Tamura et al. | |

FOREIGN PATENT DOCUMENTS

| | | |
|---|---|---|
| JP | 7-187479 | 7/1995 |
| JP | 10-129921 | 5/1998 |
| JP | 11-124273 | 5/1999 |

* cited by examiner

*Primary Examiner*—H. Grant Skaggs
(74) *Attorney, Agent, or Firm*—Oblon, Spivak, McClelland, Maier & Neustadt, P.C.

(57) ABSTRACT

A sheet finishing apparatus including a sheet tray, a pair of jogging fences, and a case. The sheet tray stacks a plurality of sheets that have been sent from an image forming apparatus. The pair of jogging fences hold the sheets stacked in the sheet tray and jog the sheets in a transverse direction relative to a sheet transferring direction. The jogging fences are moved toward and away from each other. The case encloses the apparatus and includes a plate covering the sheet tray from an operator accessible side. The plate has an opening. When the pair of jogging fences is expanded to outward limits, one of the pair of jogging fences at the operator accessible side is passed by the plate through the opening and located at an outside position relative to the plate.

21 Claims, 11 Drawing Sheets

METHOD AND APPARATUS FOR SHEET FINISHING CAPABLE OF PERFORMING AN EFFECTIVE JOGGING PROCESS

BACKGROUND OF THE INVENTION

1. Field of the Invention

The present invention relates to a method and apparatus for sheet finishing, and more particularly to a method and apparatus for sheet finishing which is capable of performing an effective jogging process.

2. Description of the Related Art

A sheet finishing apparatus is typically connected to or integral with an image forming apparatus. The sheet finishing apparatus receives a sheet having printed matter thereon from the image forming apparatus in order to provide the printed sheet with various post-image-forming processes including jogging, sorting, stapling, punching, etc. Such an apparatus normally has a complex structure with various mechanisms packed into a single body. As a result, such sheet finishing devices are typically ineffective in preventing paper jams and it is typically difficult to remove paper jams therefrom. Several attempts have been made to improve the paper jam handling of such sheet finishing devices.

A published Japanese unexamined patent application, No. 7-187479 (1995), describes an apparatus that automatically ejects any sheet left in a jogger unit to an ejection tray and that unifies several post-image-forming functions such as jogging, stapling, ejection in one unit. The sheet left in the jogger unit, however, is normally not used and therefore it should not be mixed with other sheets in the ejection tray. In addition, the unified processes result in a complex mechanism and an increase in manufacturing costs.

Another published Japanese unexamined patent application, No. 10-129921 (1998), describes an apparatus in which an external cover is unified with a drawing unit in order to decrease manufacturing costs of the apparatus. In fact, however, the cost is relatively high in comparison with an apparatus in which the unit does not include a drawing unit.

SUMMARY OF THE INVENTION

The present invention provides a novel sheet finishing apparatus that is configured to be connected with an image forming apparatus. In one example, a novel sheet finishing apparatus includes a sheet tray, a pair of jogging fences, and a case. The sheet tray stacks a plurality of sheets that have been sent from an image forming apparatus. The pair of jogging fences holds the sheets stacked in the sheet tray and jog the sheets in a transverse direction relative to a sheet transferring direction. The pair of jogging fences is controlled to move inwards and outwards (i.e. toward and away from each other). The case encloses the apparatus and includes a plate covering the sheet tray from an operator accessible side. The plate has an opening. When the pair of jogging fences are expanded to outward limits, one of the pair of jogging fences at the operator accessible side is brought to pass by the plate through the opening and to locate at a position outside relative to the plate.

When a sheet jam occurs in the sheet tray, the pair of jogging fences is expanded to have a predetermined distance away from each other.

The pair of jogging fences preferably includes a first jogging member for jogging the sheets in a transverse direction relative to the sheet transferring direction and a second jogging member for jogging the sheets in a direction of a sheet thickness. When the pair of jogging fences is expanded to the predetermined distance away from each other, a closest distance between an edge of the second jogging member at a center side of the sheet tray and an edge of the opening of the plate is sufficient for a manual removal of the sheet jammed in the sheet tray.

The present invention further provides a novel sheet finishing apparatus that is configured to be connected to an image forming apparatus. In one example, a novel sheet finishing apparatus includes a sheet tray, a pair of jogging fences, and a controller. The sheet tray stacks a plurality of sheets that have been sent from an image forming apparatus. The pair of jogging fences holds the sheets stacked in the sheet tray and jogs the sheets in a transverse direction relative to a sheet transferring direction. The controller controls the pair of jogging fences to move inwards and outwards. At a power-on time, the controller controls the pair of jogging fences to move a predetermined distance away from each other and to stop for a predetermined time period when a sheet is detected in the pair of jogging fences.

When the pair of jogging fences are moved the predetermined distance away from each other, the pair of jogging fences may be positioned at the home position, or they may be positioned at or close to the most expanded position.

The present invention further provides a novel method of sheet jogging. In one example, a novel method of sheet jogging includes the step of providing a power to a sheet finishing apparatus. The method includes a step of determining whether a sheet remains in a sheet tray for stacking a plurality of sheets that have been sent from an image forming apparatus. The method also includes a step of moving a jogging member a predetermined distance when a sheet is detected in the sheet tray, where the jogging member holds sheets stacked in the sheet tray and jogs the sheets in a transverse direction relative to a sheet transferring direction. The method further includes the step of stopping the jogging member for a predetermined time period.

When the jogging member is moved the predetermined distance, the jogging member may be positioned at the home position, or may be positioned at or close to the most expanded position.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
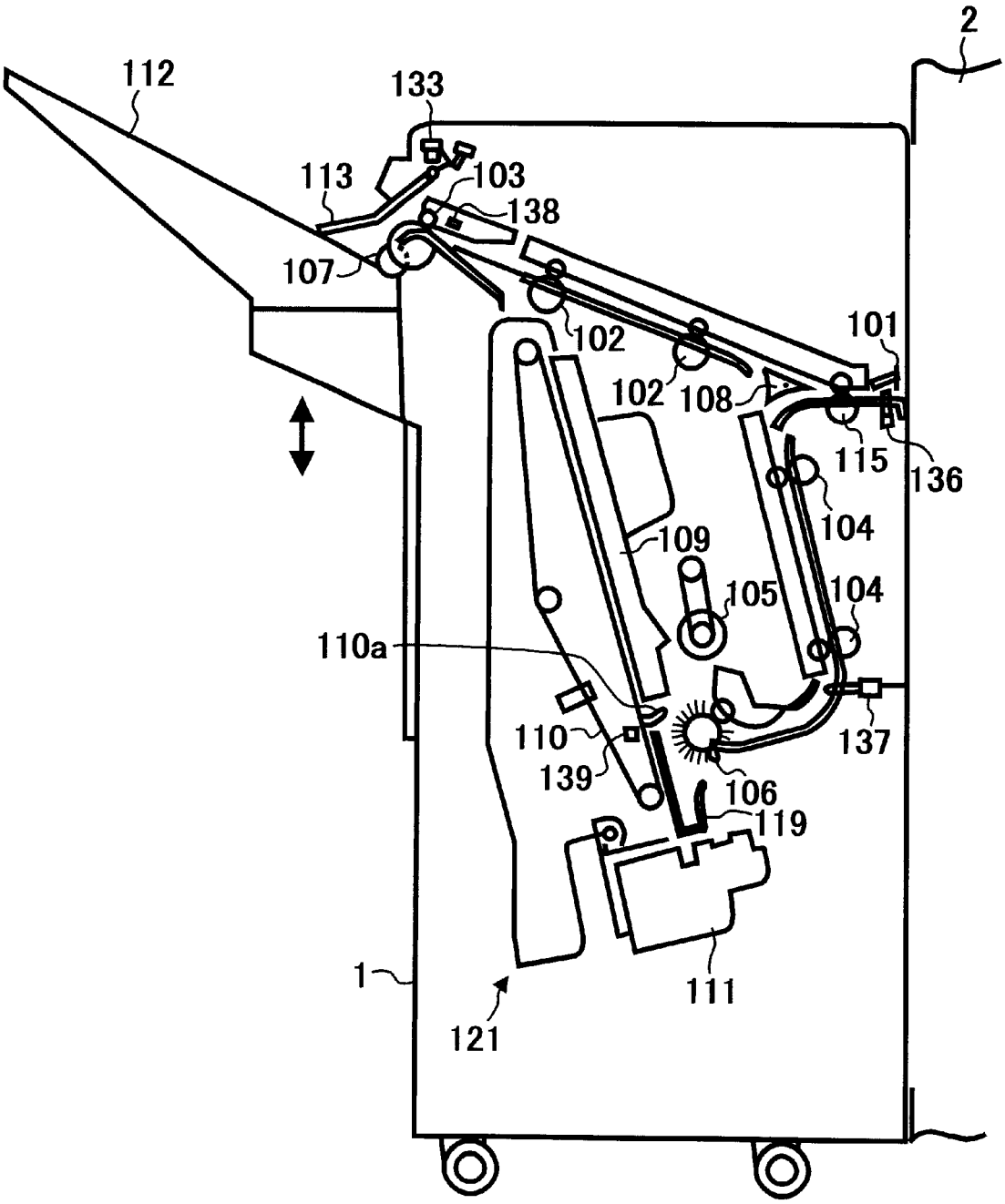
FIG. 1 is a schematic cross-sectional view of a sheet finishing apparatus according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Throughout the various figures like reference numerals are used to designate identical or corresponding parts.

FIG. 1 depicts a sheet finishing apparatus 1 according to a preferred embodiment of the present invention. As shown in FIG. 1, the sheet finishing apparatus 1 includes a sheet inlet 101 that is connected to an image forming apparatus 2. A sheet passage following the sheet inlet 101 is provided with an inlet sensor 136, a pair or inlet rollers 115, and a branch pawl 108. The branch pawl 108 switches the directions of advancing sheets either to an ejection tray 112 or to a stapling apparatus 111. A sheet passage connected to the ejection tray 112 is provided with upper passage rollers 102, an ejection sensor 138, an ejection roller 103, a shift roller 107, a sheet level lever 113, and a sheet level sensor 133. A sheet passage connected to the stapling apparatus 111 is provide with lower passage rollers 104, an ejection sensor 137, and sheet feed rollers 106 (i.e., brush rollers). The lower passage rollers 104 are driven by a motor, i.e., a feed motor 54 (described below and depicted in FIG. 8), and the ejection tray 112 is moved in horizontal and vertical directions by motors, for example, a vertical motor 51 and a shift motor 52 (both described below).

The stapling unit 111 is mounted under a stapling tray 121. The stapling tray 121 is provided with jogger fences 109 for jogging a stack of sheets stacked on the stapling tray 121, a return roller 105, and a lifting belt 110 for lifting a stack of stapled sheets. The lifting belt 110 is arranged behind the jogger fences 109 and includes a lifting pawl 110*a*. In FIG. 1, reference numeral 119 denotes a trailing edge fence and reference numeral 139 denotes a sheet detecting sensor.

Figure 2:
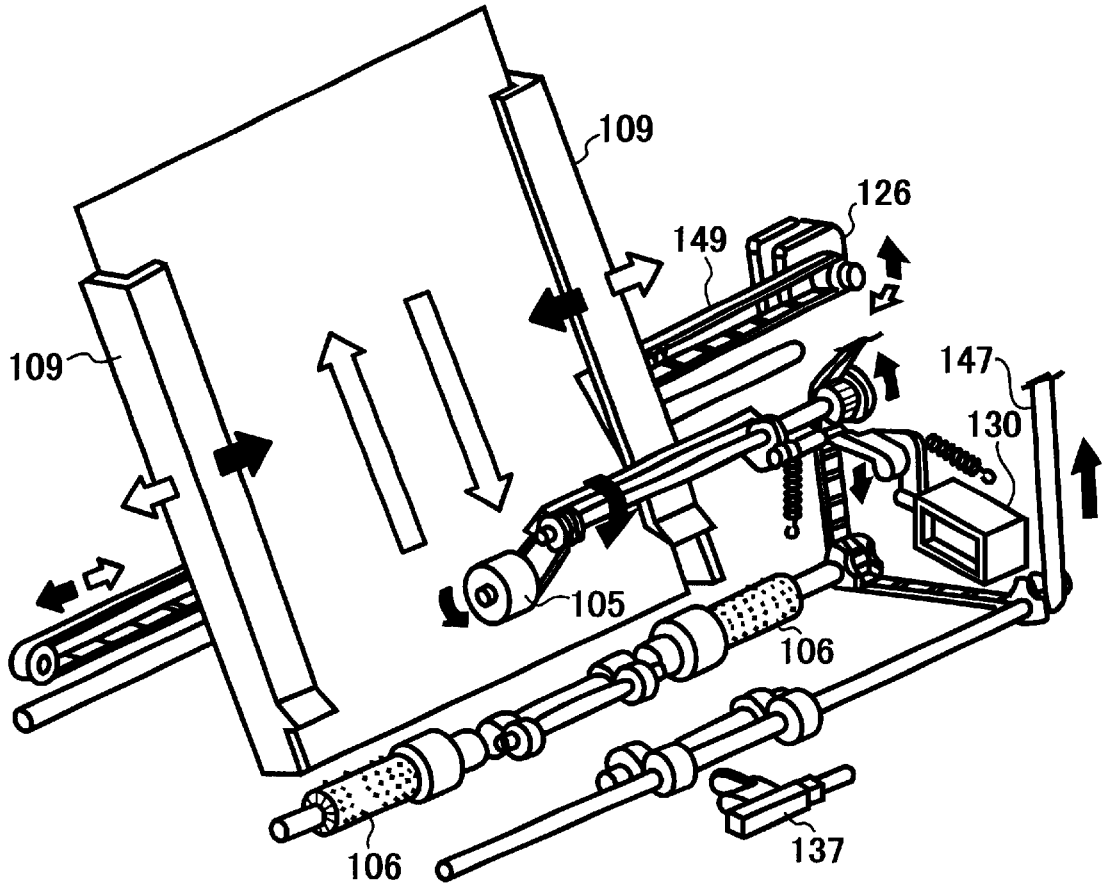
FIG. 2 is a schematic view explaining a stapling tray of the sheet finishing apparatus of FIG. 1.

FIG. 2 depicts a jogging mechanism of the sheet finishing apparatus 1. As shown in FIG. 2, the jogger fences 109 are configured to travel leftward and rightward due to the clockwise and counterclockwise rotation of a jogger belt 149 driven by a jogger motor 126, which is rotated in forward and backward directions. The return roller 105 is moved back and forth by a return solenoid 130 so as to move away from the surface of the sheet in a transferring process. Reference numeral 147 denotes a driving belt which transmits a driving force generated by the feed motor 54 to one of the sheet feed rollers 106 and to one of the lower passage rollers 104 (FIG. 1).

Figure 3:
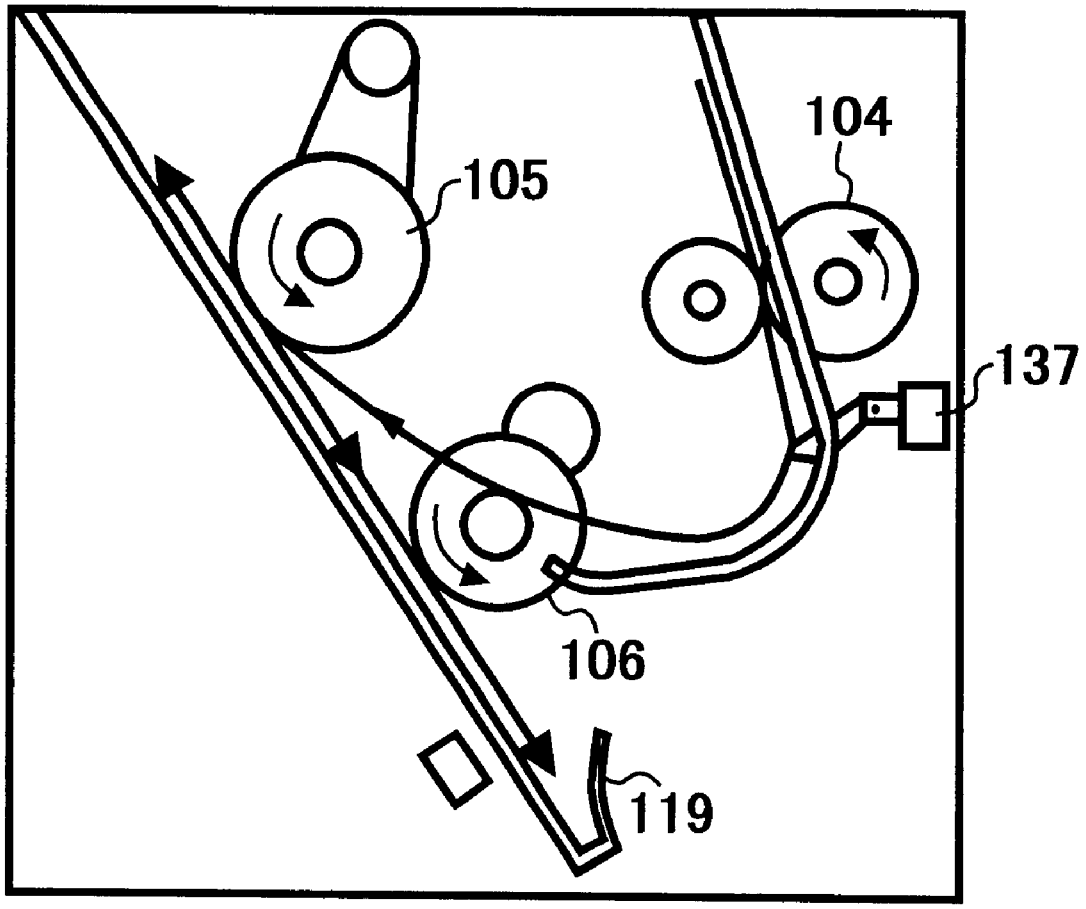
FIG. 3 is a schematic view explaining how a sheet is transferred into a trailing edge fence.

The trailing edge fence 119 is arranged under the jogger fences 109 to receive the trailing edge of the sheet after the completion of the transferring process. In this case, the sheet is sent downwards by the return roller 105, driven by the return solenoid 130, and the sheet feed rollers 106 along the jogger fences 109. Thereby, the sheets are jogged at the trailing edge sides by the trailing edge fence 119, as shown in FIG. 3.

Figure 4:
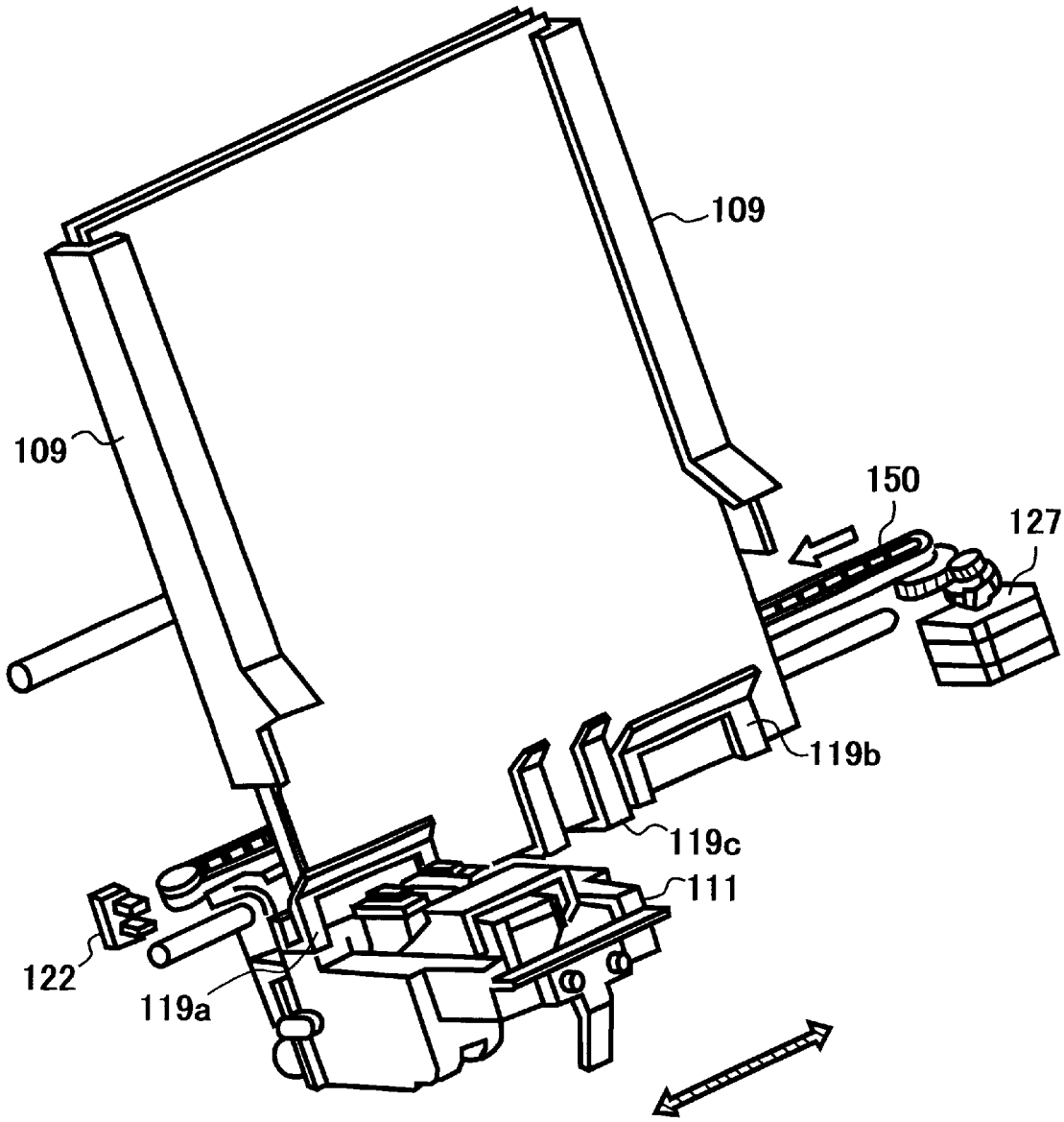
FIG. 4 is a perspective view depicting the trailing edge fence.

As shown in FIG. 4, the trailing edge fence 119 includes a left fence 119*a*, a right fence 119*b*, and a center fence 119*c* that are arranged at left, right, and center sides, respectively, and are movably engaged with the stapling unit 111 in a manner independent of one another.

The ejection sensor 137 is arranged at a position such that the return roller 105 contacts the trailing edge surface of the sheet when the ejection sensor 137 detects the trailing edge of the sheet and the return solenoid 130 activates the return roller 105.

The stapling unit 111 is moved in the left and right directions, as shown in FIG. 4, by the rotary movement of a stapling belt 150 driven by a stapler shift motor 127, which is rotated in the forward and backward directions. The stapling unit 111 performs a stapling operation in a variety of ways such as a single front stapling, a single deep-inside stapling, a double stapling, etc. In FIG. 4, reference numeral 122 is a home position sensor for detecting a home position of the stapling unit 111.

Figure 5:
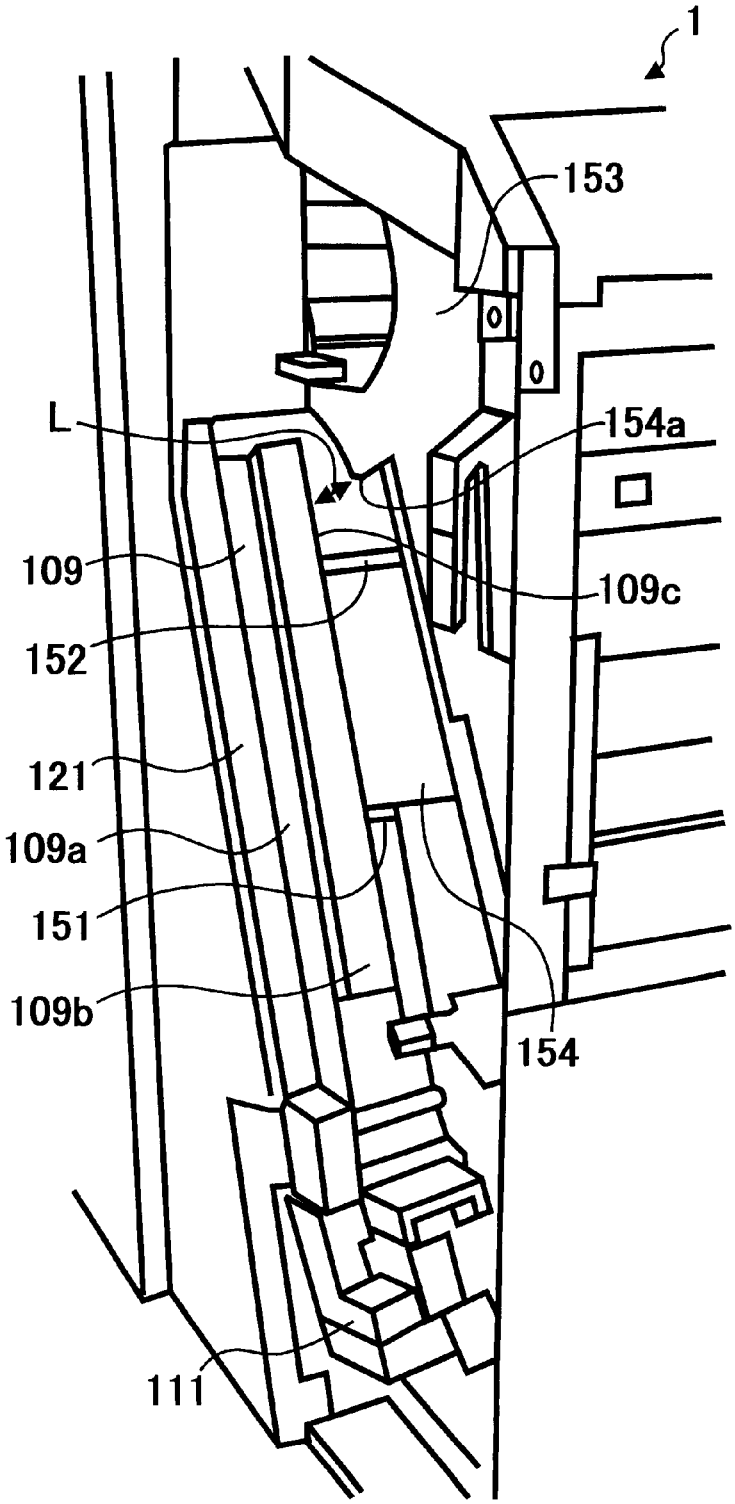
FIG. 5 is a perspective view depicting a position at which a jogging fence is located outside a case of the apparatus of FIG. 1.
Figure 6:
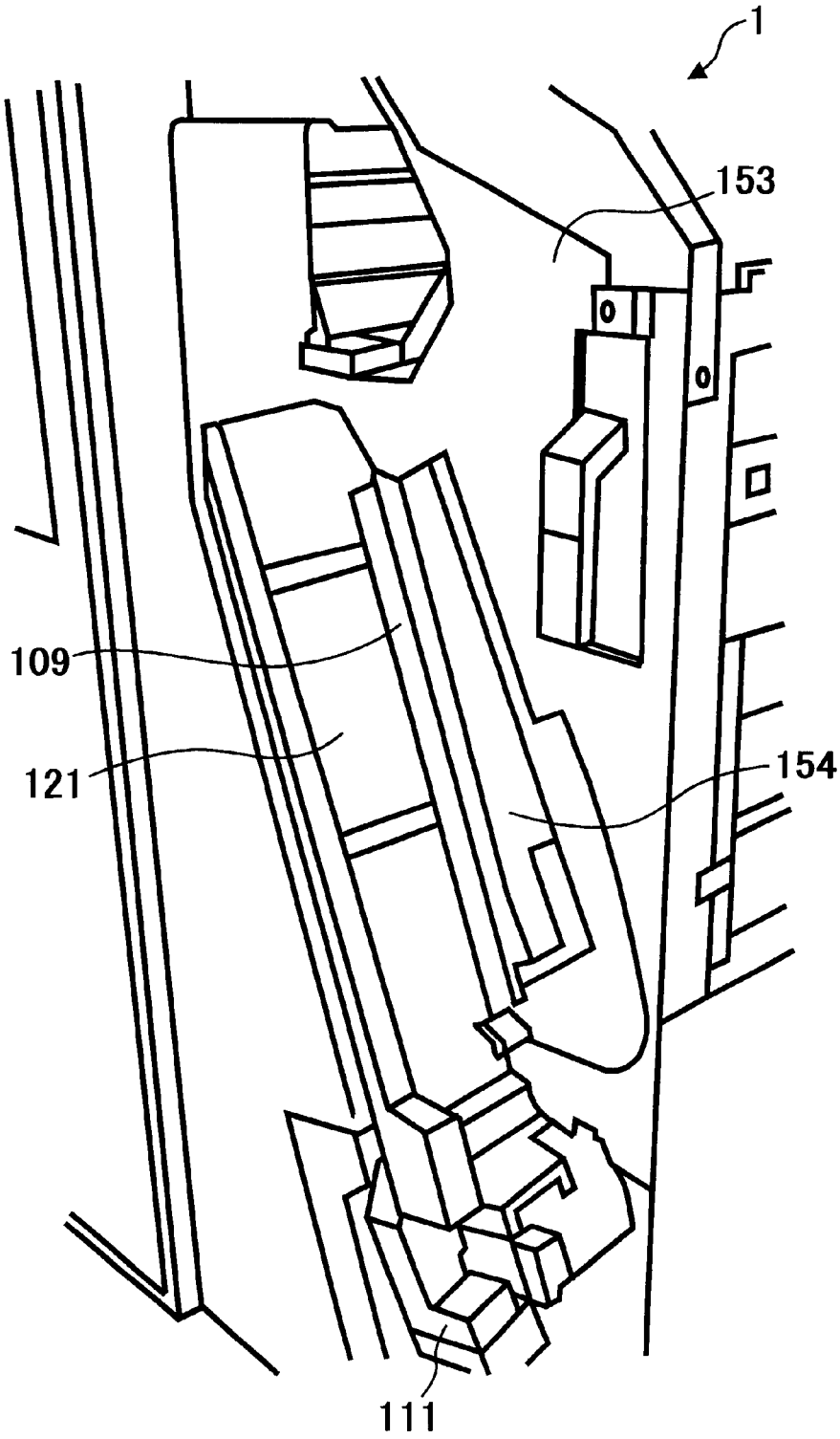
FIG. 6 is a perspective view depicting a position at which the jogging fence is located inside the case of the apparatus of FIG. 1.

FIG. 5 shows positions of the jogger fences when the sheets are jogged in the stapling tray 121 and FIG. 6 shows positions of the jogger fences when the jogger fences are moved at the most external position to allow the user to pick up the sheets. As shown in FIGS. 5 and 6, the stapling tray 121 is mounted on the sheet finishing apparatus 1 and the jogger fences 109 are moved back and forth along shafts 151 and 152. The jogger fences 109 can be located at three different positions: a widest expanding position for the jogger fences 109 shown in FIG. 5; a sheet jogging position shown in FIG. 6; and a home position. The home position is arranged close to the widest expanding position. The widest expanding position is arranged to maintain at least a distance L between the jogger fence 109 and a front-and-side plate 153 which is a part of a housing of the apparatus so that the sheets is easily taken out from an opening 154.

Each jogger fence 109 includes a first regulating portion 109*a* for jogging the sheet in a direction perpendicular to the sheet transferring direction and a second regulating portion 109*b* for regulating the sheets stacked in the stapling unit 121 in the direction of thickness of the sheet. The above-mentioned distance L is defined as a distance between an edge portion 109*c* inside the second regulating portion 109*b* and an edge portion 154*a* of the opening 154, which faces most closely the edge portion 109*c*.

Figure 7:
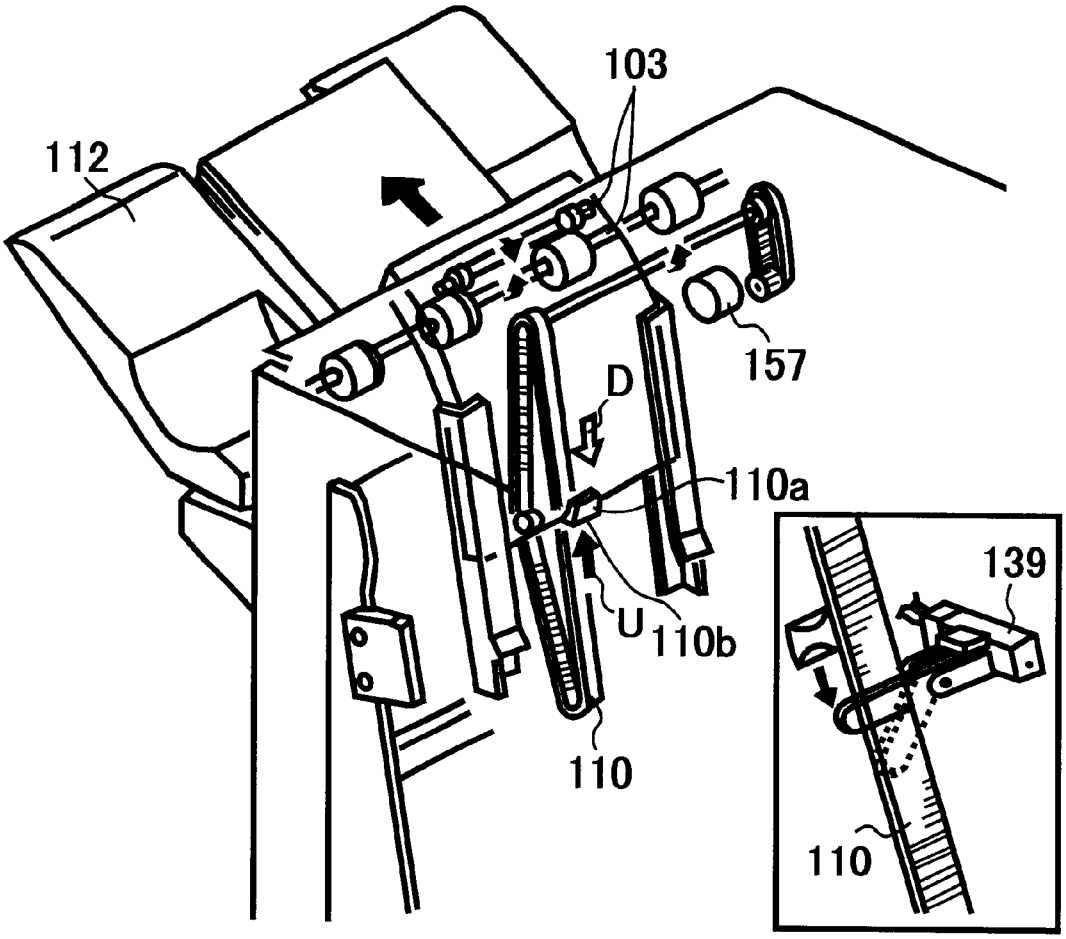
FIG. 7 is a schematic view explaining an ejection of a stack of sheets by a lifting belt.

The lifting belt 110 is moved by a reverse-rotatable lifting belt motor 157 in the sheet transferring direction, as shown in FIG. 7. That is, the lifting belt 110 is moved upwards when the stack of sheets is lifted up for ejection and downwards when the stack of sheets is in a process of jogging in the sheet transferring direction. In addition to the jogging operation with the return roller 105 and the trailing edge fence 119, the leading edge jogging is also performed when the sheets are in one size. That is, a lower edge portion 110*b*, which is a rear side of the lifting pawl 110*a*, is brought into contact with the leading edge of the stack of sheets. When a multiple sheet transfer is performed, the return roller 105 is moved to contact the first sheet and therefore the above-mentioned jogging by the lower edge portion 110*b* is needed.

Figure 8:
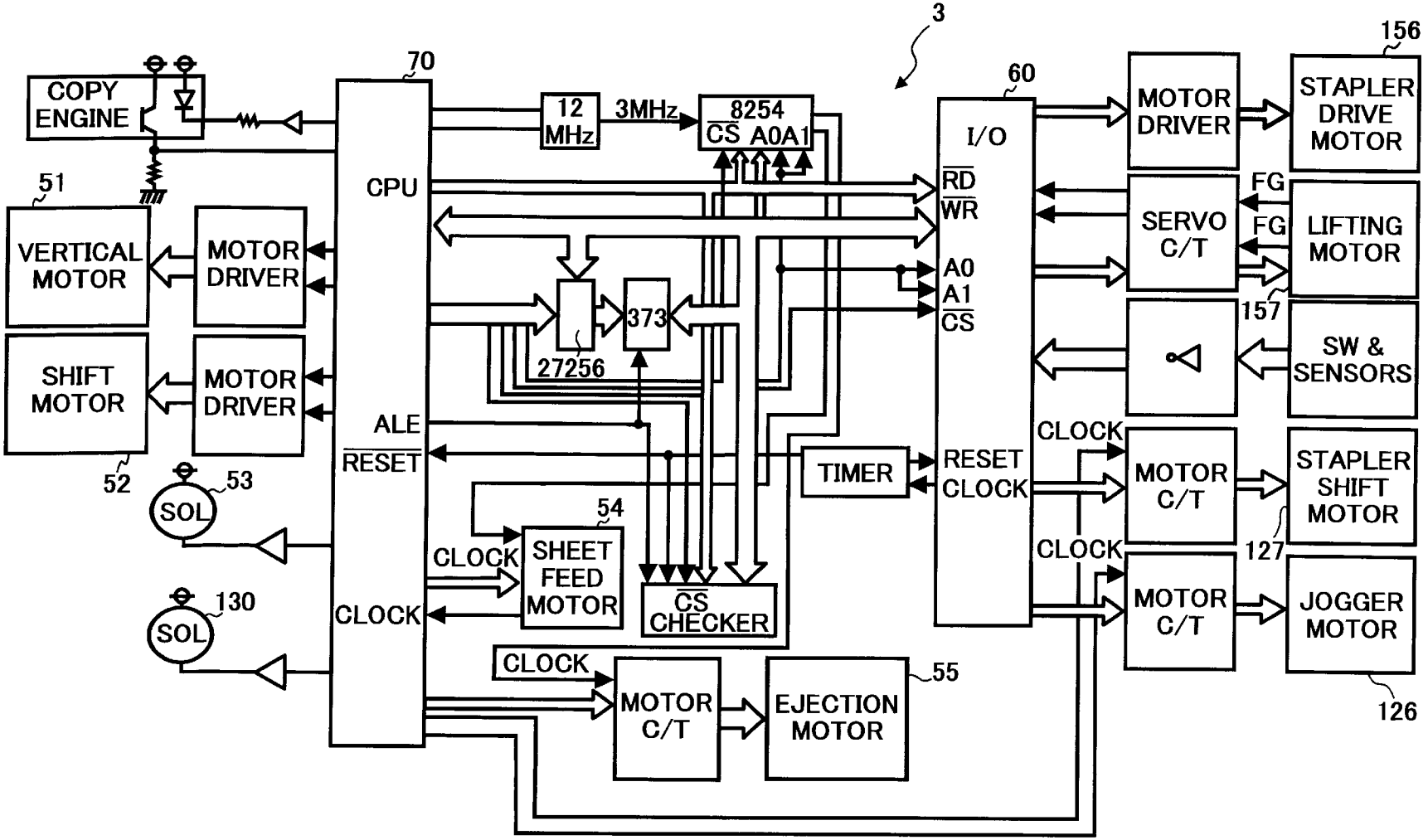
FIG. 8 is a block diagram of a microcomputer circuit of the sheet finishing apparatus of FIG. 1.

Next, an exemplary configuration of a microcomputer circuit 3 provided in the sheet finishing apparatus 1 is explained with reference to FIG. 8. As shown in FIG. 8, the microcomputer circuit 3 includes a central processing unit (CPU) 70 to which signals from various switches of a control panel (not shown) and the sensors are input via an input and output (I/O) interface 60. In response to the input signals, the CPU 70 activates the vertical motor 51, the shift motor 52, a branch solenoid 53, the sheet feed motor 54, an ejection motor 55, the jogger motor 126, the stapler shift motor 127, the return solenoid 130, a stapling motor 156, the reverse-rotatable lifting belt motor 157, and a punch motor (not shown). Pulse signals generated by the sheet feed motor 54 are input to and counted by the CPU 70. In response to a value of this count, the return solenoid 130 is controlled. A synchronous control means includes the CPU 70 and a variety of operation programs including a program explained later and shown in FIG. 11.

An operation of the sheet finishing apparatus 1 in a non-stapling mode is explained below. A sheet sent from the image forming apparatus 2 and which has therefore been subjected to the image forming process is received by the sheet inlet 101 and is sent to the upper passage by the branch pawl 108. The sheet is then fed by the sheet passage rollers 102 and is ejected by the ejection roller 103. The sheet is jogged by the shift roller 107 in the sheet transferring direction and is stacked in the ejection tray 112. The rotation speed of the shift roller 107 is reduced when the ejection sensor 137 detects the trailing edge of the sheet so as to make sure that the sheet is ejected into the ejection tray 112. As a plurality of the sheets are stacked in the ejection tray 112, the sheet level lever 113 and the sheet level sensor 133 detect the height of the sheet surface and, in accordance with this height, the vertical motor 51 is driven so that the height of the sheet surface is kept at a predetermined level.

Figure 9:
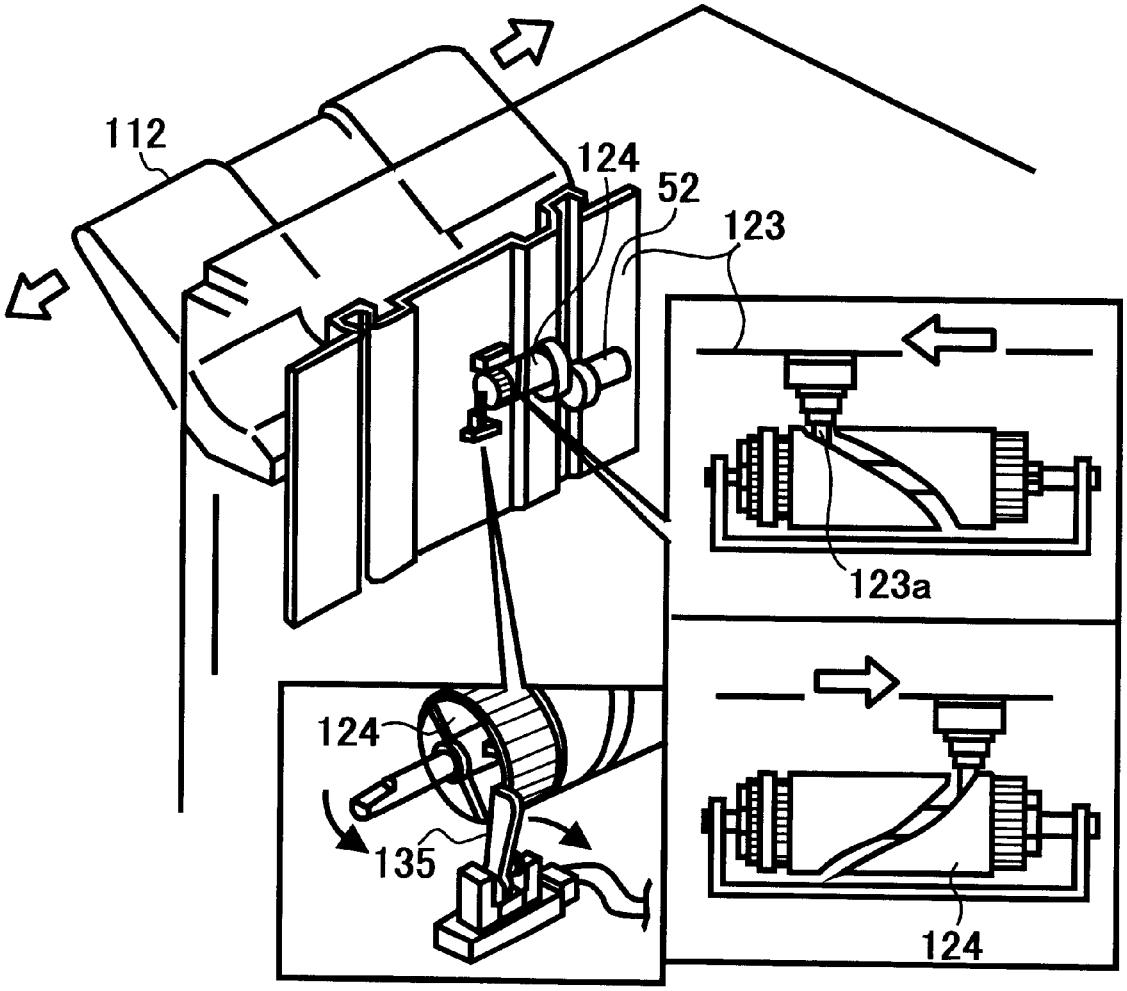
FIG. 9 is a schematic diagram for explaining a shift mechanism for shifting an ejection tray of the sheet finishing apparatus of FIG. 1.

During a sorting mode and a stacking mode, the microcomputer circuit 3 receives a sheet separation signal from a control circuit of the image forming apparatus 2 and, in accordance with the sheet separation signal, instructs the shift motor 52 to move the ejection tray 112 so that the ejection tray 112 shifts in the direction transverse relative to the sheet transferring direction from time to time until the job is ended. The shift operation is performed such that an end fence 123 is slid with a cylindrical cam 124 and a cam follower 123*a* driven by the shift motor 52, as shown in FIG. 9. A stop position of the ejection tray 112 is detected by a shift sensor 135. The ejection tray 112 is moved down for approximately thirty millimeters when the job is ended.

An operation of the sheet finishing apparatus 1 in a stapling mode is explained below. When the stapling mode is selected, the jogger fences 109 are moved from their home positions to standby positions approximately seven millimeters away from the edges of the sheet, as shown in FIG. 2. The sheet is transferred by the lower passage rollers 104 which are driven by the sheet feed motor 54. When the trailing edge of the sheet passes the position of the ejection sensor 137, the jogger fences 109 perform the jogging process towards the inside directions relative to positions five millimeters away from the standby positions. The ejection sensor 137 detects the trailing edge of the passing sheet and sends a signal to the CPU 70 which will then start to count the pulses generated by the sheet feed motor 54 and drives the return solenoid 130 when the count number reaches a predetermined value. The return roller 105 is moved back and forth by the on-and-off motion of the return solenoid 130. When the return solenoid 130 is turned on, the return roller 105 touches the sheet to move it down. The sheet is thus dropped and stopped by the trailing edge fence 119. As a result, the sheets are jogged. During the above operation, when the inlet sensor 136 detects the sheet, it sends a signal to the CPU 70 which will count the number of this signal and regards it as information indicating a number of sheets stacked in the ejection tray 121.

In a predetermined time period after the return solenoid 130 is turned off, the jogger fences 109 are moved 2.6 mm inside by the jogger motor 126 and are stopped there, thereby completing the jogging in the directions transverse relative to the sheet transferring direction. The jogger fences 109 are then moved backwards again for 7.6 mm and are stopped to wait for the next sheet.

The above-described operations are repeated in each sheet handling cycle until the last sheet of the job is finished. During the operation for the last sheet on the job, the jogger fences 109 are caused to perform the 7.6 mm jogging operation again at the end of the process so as to hold both sides of the stack of sheets in preparation for the stapling process. At a predetermined time after this repeated jogging process, the stapling unit 111 begins to perform the stapling process. When the stapling unit 111 is in the double stapling mode, after the first stapling process is ended, the stapling unit 111 is moved by the stapler shift motor 127 to the second stapling position along the trailing edge of the sheet so as to perform the second stapling process.

After the stapling operation, the lifting belt motor 157 is driven to move the lifting belt 110. At the same time, the ejection motor 55 is also driven so that the stack of sheets lifted up by lifting pawl 110*a* is received. The jogger fences 109 are controlled to differently perform the jogging operation depending upon the size of the sheet and the number of sheets to be stacked. For example, when the size of the sheet is smaller than a predetermined size or when the number of sheets to be stacked is smaller than a predetermined number, the stack of sheets is held at both sides thereof by the jogger fences 109 and is lifted up at the trailing edge thereof by the lifting pawl 110*a*. In a certain time period corresponding to a predetermined number of pulses counted by a home sensor (not shown) for the lifting belt 110, the jogger fences 109 are moved outwards 2.6 mm away from the present positions to release the stack of sheets. This predetermined number of pulse counts is defined as a number to correspond a time period from a time the trailing edge of the sheet touches the lifting pawl 110*a* to a time the lifting pawl 110*a* is moved above the jogger fences 109. When the size of the sheet is greater than a predetermined size or when the number of sheets to be stacked is greater than a predetermined number, the jogger fences 109 is initially moved outwards 2.6 mm away from the present positions and the stack of sheets is then lifted up at the trailing edge thereof by the lifting pawl 110*a*. In any case when the stack of sheets is moved above the jogger fences 109, the jogger fences 109 are moved further outwards back to the standby positions for the next sheet. The force of the jogger fences 109 used to hold the stack of sheets can be changed by adjusting the distance of the jogger fences 109 relative to the stack of sheets. The above series of the processes are repeated to the last sheet.

Figure 10:
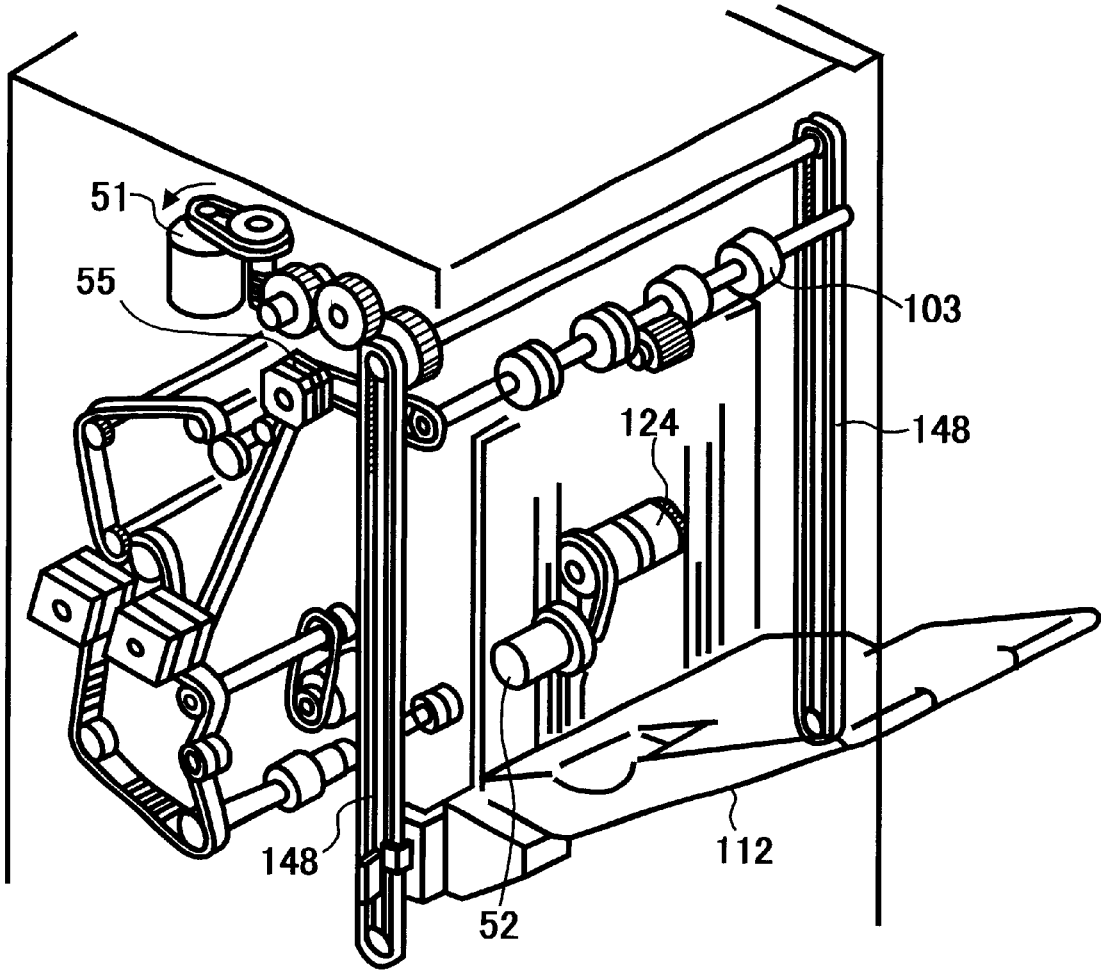
FIG. 10 is a perspective view of an elevation mechanism for elevating the ejection tray.

As shown in FIG. 10, the ejection tray 112 is hung with lifting belts 148. The lifting belts 148 are driven by the vertical motor 51, each via a series of gears and a timing belt. The lifting belts 148 are moved upwards and downwards according to the forward and reverse rotations of the vertical motor 51. The home position and the travel position of the ejection tray 112 is detected by the sheet level sensor 133 with the sheet level lever 113. A lower limit sensor (not shown) is used to detect when the ejection tray 112 is filled with the stack of sheets. Further, when the ejection tray 112 touches the shift roller 107 during the elevation, it is detected by an upper limit sensor (not shown) and the vertical motor 51 is stopped so as not to overrun.

Figure 11:
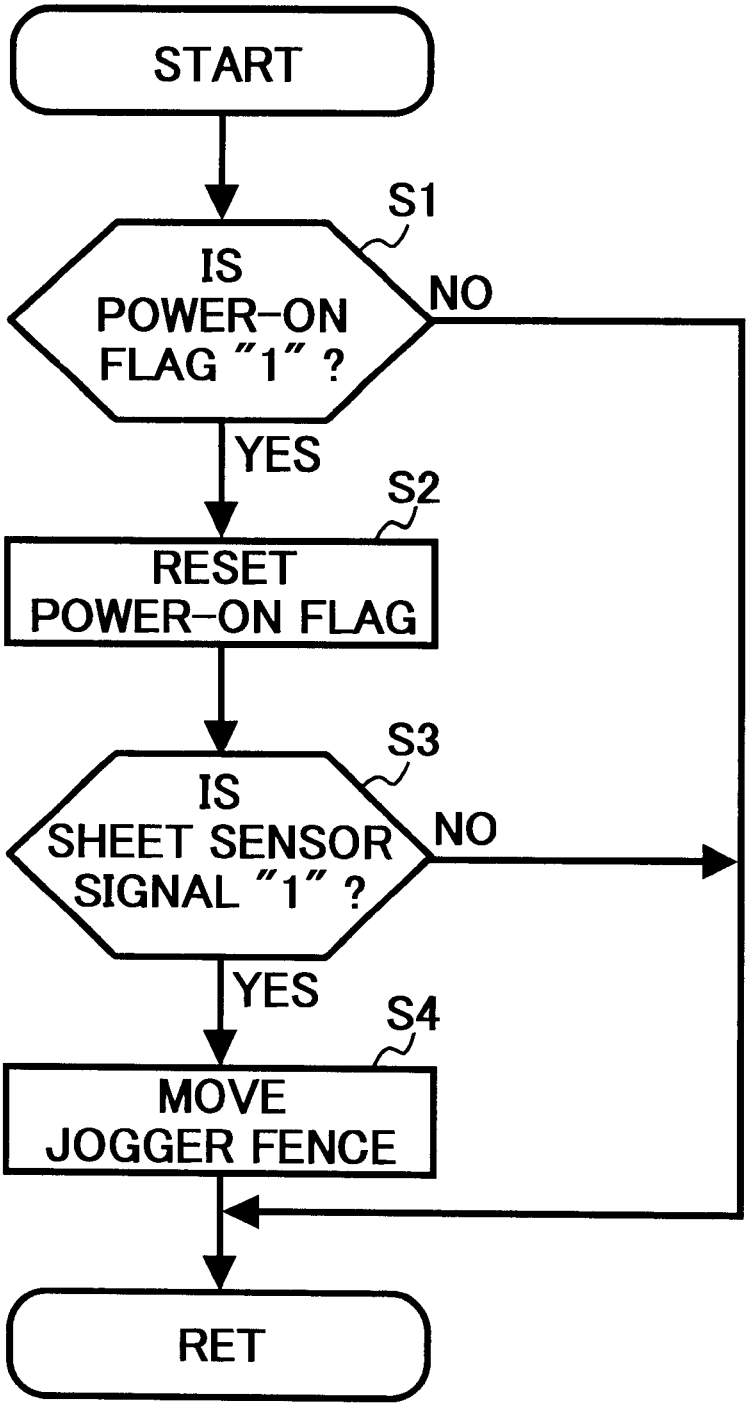
FIG. 11 is a flowchart of an exemplary procedure of an initial remaining sheet checking process performed by the sheet finishing apparatus of FIG. 1.

FIG. 11 shows an exemplary procedure of an initial remaining sheet checking process for checking if any sheet remains in the stapling tray 121 at a power-on time. This process is performed by the above-described sheet finishing apparatus 1. In the process diagramed in FIG. 11, the stapling tray 121 is checked when the power is switched on and, if it detects an event that a sheet is present in the stapling tray 121, the jogger fences 109 are moved outwards so that the sheet can be taken out manually by the user. The detection of the sheet inside the stapling tray 121 is performed by the sheet detecting sensor 139.

In Step S1 of FIG. 11, the CPU 70 checks whether a power-on flag is high, wherein when the power is on the power-on flag is high and when the power is off the power-on flag is low. When the power-on flag is low, the process ends. When the power-on flag is high, the power-on flag is reset to low, in Step S2. The power-on flag is normally preset to high before the program enters a main routine after the CPU 70 is initialized when the main power is switched on.

Then, in Step S3, the CPU 70 checks the status of the sheet detecting sensor 139. If the sheet detecting sensor 139 is off and the check result of Step S3 is NO, the process ends. If the sheet detecting sensor 139 is on and the check result of Step S3 is YES, a jogging sub-routine for performing the jogging process is initiated, in Step S4. By performing the jogging sub-routine, the jogger fences 109 of the stapling tray 121 are moved outwards. As described above, the jogger fences 109 are driven by the jogger motor 126 so as to move away from each other. In this process, it is preferable that the jogger fences 109 are expanded for a sufficient distance for the user to be able to pick up the sheet present in the stapling tray 121, for example. It is also preferable that the jogger fences 109 are moved outwards until it comes close to the home position sensor 122 for the stapling unit 111. The home position sensor 122 for the stapling unit 111 is mounted at or close to the home position of the jogger fences 109 where the jogger fences 109 are expanded outwards for the maximum extent, as describe above.

With the above arrangement, the user is provided with sufficient space to remove a jammed sheet, for example, without the need for unifying the stapling tray 121 and the stapling unit 111 into one unit in order to be drawn out to remove the jammed sheet. The present embodiment provides for the movement of the jogger fences 109 towards the operation side (the left side in FIG. 5) for a distance sufficient to extend through the opening 154 such that the operator can remove the paper jam without having to pull the stapling tray 121 and stapling unit 111 out of the sheet finishing apparatus. Such a configuration is not present in the related art structures, which require the stapling tray and stapling unit be provided in one unit in order to facilitate removal of a paper jam.

When the stapling mode is cancelled during the execution of the stapling mode, or when a power-down is caused before a paper jam error is cleared, the sheet erroneously remains in the apparatus and the jammed sheet is needed to be removed from the apparatus when the power is next turned on. In such a case, if the jogger fences 109 are located at the most outward positions as described above, the user can easily recognize that a sheet remains in the apparatus by checking the position of the jogger fences 109 and can easily remove the remaining sheet through the reserved opening 154.

Obviously, numerous additional modifications and variations of the present invention are possible in light of the above teachings. It is therefore to be understood that within the scope of the appended claims, the present invention may be practiced otherwise than as specifically described herein.

This document is based on Japanese Patent Application No. JPAP2000-188059 filed on Jun. 22, 2000, in the Japanese Patent Office, the entire contents of which are incorporated herein by reference.

What is claimed as new and is desired to be secured by Letters Patent of the United States is:

1. A sheet finishing apparatus, comprising:

a sheet tray adapted to stack a plurality of sheets sent from an image forming apparatus;

a pair of jogging fences adapted to extend along side edges of the sheets and hold the sheets stacked in said sheet tray and adapted to jog the sheets in a transverse direction relative to a sheet transferring direction, said pair of jogging fences being configured to be moved toward and away from each other; and a case enclosing said apparatus, said case including a plate covering said sheet tray from an operator accessible side, said plate having an opening, wherein one of said pair of jogging fences at said operator accessible side is configured to extend through said opening in said plate and be located at an outside position relative to said plate when said pair of jogging fences is expanded to outward limits.

2. A sheet finishing apparatus as defined in claim 1, wherein said pair of jogging fences is configured to expand to a predetermined distance away from each other when a sheet jam occurs in said sheet tray.

3. A sheet finishing apparatus as defined in claim 2, wherein at least one jogging fence of said pair of jogging fences comprises:

a first regulating portion adapted to jog the sheets in a transverse direction relative to the sheet transferring direction; and a second regulating portion adapted to regulate the sheets in a direction of a sheet thickness.

4. A sheet finishing apparatus as defined in claim 3, wherein when said pair of jogging fences is expanded to have said predetermined distance away from each other, a closest distance between an edge of said second regulating portion at a center side of said sheet tray and an edge of said opening of said plate is sufficient for a manual removal of the sheet jammed in said sheet tray.

5. A sheet finishing apparatus, comprising:

a sheet tray adapted to stack a plurality of sheets sent from an image forming apparatus;

a pair of jogging fences adapted to hold the sheets stacked in said sheet tray and adapted to jog the sheets in a transverse direction relative to a sheet transferring direction; and a controller configured to control said pair of jogging fences to move toward and away from each other, said controller being configured to control said pair of jogging fences at power-on time when power is switched from off to on to move a predetermined distance away from each other and to stop for a predetermined time period if a sheet is detected in said pair of jogging fences.

6. A sheet finishing apparatus as defined in claim 5, wherein said pair of jogging fences is configured to be positioned at home positions when said pair of jogging fences is moved for said predetermined distance away from each other.

7. A sheet finishing apparatus as defined in claim 5, wherein said pair of jogging fences is configured to be positioned at about most expanded positions when said pair of jogging fences is moved for said predetermined distance away from each other.

8. A sheet finishing apparatus, comprising:

a sheet tray adapted to stack a plurality of sheets;

a pair of jogging fences adapted to extend along side edges of the sheets and hold the sheets stacked in said sheet tray and adapted to jog the sheets in a transverse direction relative to a sheet transferring direction;

a controller configured to move said pair of jogging fences toward and away from each other; and a case enclosing said apparatus, said case including a plate covering said sheet tray, said plate having an opening, wherein said pair of jogging fences is configured to move away from each other to a position such that one of said pair of jogging fences extends through said opening and is located at a position outside of said case.

9. A sheet finishing apparatus as defined in claim 8, wherein at least one jogging fence of said pair of jogging fences comprises:

a first regulating portion adapted to jog the sheets in a transverse direction relative to the sheet transferring direction; and a second regulating portion adapted to regulate the sheets in a direction of a sheet thickness.

10. A sheet finishing apparatus as defined in claim 9, wherein when said pair of jogging fences is expanded to have said predetermined distance away from each other, a closest distance between an edge of said second regulating portion at a center side of said sheet tray and an edge of said opening of said plate is sufficient for a manual removal of the sheet jammed in said sheet tray.

11. A sheet finishing apparatus as defined in claim 8, wherein said controller is configured to control said pair of jogging fences at power-on time to move a predetermined distance away from each other and to stop for a predetermined time period when a sheet is detected in said pair of jogging fences.

12. A sheet finishing apparatus, comprising:

sheet stacking means for stacking a plurality of sheets sent from an image forming apparatus;

jogging means extending along side edges of the sheets for holding the sheets stacked in the sheet stacking means and for jogging the sheets in a transverse direction relative to a sheet transferring direction, said jogging means being controlled to be moved inwards and outwards; and casing means for enclosing said apparatus, said case means including a plate covering said sheet stacking means from an operator accessible side, said plate having an opening, wherein said jogging means at said operator accessible side is configured to extend through said opening in said plate and be located at an outside position relative to said plate when said jogging means is expanded to outward limits.

13. A sheet finishing apparatus as defined in claim 12, wherein said jogging means is configured to be expanded a predetermined distance when a sheet jam occurs in said sheet stacking means.

14. A sheet finishing apparatus as defined in claim 13, wherein said jogging means comprise:

jogging means for jogging the sheets in a transverse direction relative to the sheet transferring direction; and regulating means for regulating the sheets in a direction of a sheet thickness, wherein when said jogging means and said regulating means are moved to have said predetermined distance away from each other, a closest distance between an edge of said regulating means at a center side of said sheet stacking means and an edge of said opening of said plate is sufficient for a manual removal of the sheet jammed in said sheet stacking means.

15. A sheet finishing apparatus, comprising:

sheet stacking means for stacking a plurality of sheets sent from an image forming apparatus;

jogging means for holding the sheets stacked in the sheet stacking means and for jogging the sheets in a transverse direction relative to a sheet transferring direction; and controlling means for controlling said jogging means to move inwards and outwards, wherein said controlling means controls said jogging means as a power-on time when power is switched from off to on to move a predetermined distance and to stop for a predetermined time period if a sheet is detected in said jogging means.

16. A sheet finishing apparatus as defined in claim 15, wherein said jogging means is configured to be positioned at the home position when said jogging means is moved for said predetermined distance.

17. A sheet finishing apparatus as defined in claim 15, wherein said jogging means is configured to be positioned at about a most expanded position when said jogging means is moved for said predetermined distance.

18. A method of sheet jogging, comprising the steps of:

determining at power-on time when power is switched from off to on whether a sheet is in a sheet tray for stacking a plurality of sheets sent from an image forming apparatus;

moving a jogging member a predetermined distance when a sheet is detected in the sheet tray to a position such that the jogging member extends through an opening in a case housing the sheet tray to a position outside of the case; and stopping the jogging member for a predetermined time period.

19. A method as defined in claim 18, wherein the predetermined distance is defined such that a closest distance between an edge of the jogging member at a center side of the sheet tray and an edge of the opening is sufficient for a manual removal of a sheet jammed in the sheet tray.

20. A method as defined in claim 18, wherein the jogging member is positioned at a home position when the jogging member is moved the predetermined distance.

21. A method as defined in claim 18, wherein the jogging member is positioned at about the most expanded position when the jogging member is moved the predetermined distance.

* * * * *